US007549736B2

(12) United States Patent
Campbell et al.

(10) Patent No.: US 7,549,736 B2
(45) Date of Patent: Jun. 23, 2009

(54) PRINTHEAD ASSEMBLY HAVING INK FLOW CHANNELS TO ACCOMMODATE OFFSET CHIPS

(75) Inventors: Michael Clark Campbell, Lexington, KY (US); David Emerson Greer, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 154 days.

(21) Appl. No.: 11/427,441

(22) Filed: Jun. 29, 2006

(65) Prior Publication Data

US 2008/0043072 A1 Feb. 21, 2008

(51) Int. Cl.
*B41J 2/05* (2006.01)

(52) U.S. Cl. ..... 347/65

(58) Field of Classification Search ..... 347/13, 347/15, 40, 42, 43, 44, 65, 93
See application file for complete search history.

(56) References Cited

U.S. PATENT DOCUMENTS 5,057,854 A * 10/1991 Pond et al. ..... 347/42
5,160,945 A * 11/1992 Drake ..... 347/42
5,719,605 A * 2/1998 Anderson et al. ..... 347/59
6,068,367 A * 5/2000 Fabbri ..... 347/49
6,250,738 B1 * 6/2001 Waller et al. ..... 347/42

* cited by examiner

*Primary Examiner*—Anh T. N. Vo
(74) *Attorney, Agent, or Firm*—Taylor & Aust, PC

(57) ABSTRACT

A printhead body includes a floor having an interior side and an exterior side. A first set of body vias extend through the floor from the interior side to the exterior side. The first set of body vias is positioned to supply ink to a first micro-fluid ejection chip. A second set of body vias extend through the floor from the interior side to the exterior side. The second set of body vias is positioned to supply ink to a second micro-fluid ejection chip. A plurality of ink flow channels are formed on the interior side of the floor. Each individual ink flow channel of the plurality of ink flow channels is in fluid communication with a particular body via of the first set of body vias and is in fluid communication with a particular body via of the second set of body vias.

12 Claims, 5 Drawing Sheets

PRINTHEAD ASSEMBLY HAVING INK FLOW CHANNELS TO ACCOMMODATE OFFSET CHIPS

FIELD OF THE INVENTION

The present invention relates to an imaging apparatus, and, more particularly, to a printhead assembly having ink flow channels to accommodate offset chips.

BACKGROUND OF THE INVENTION

An imaging apparatus, such as an ink jet printer, forms an image on a print medium, such as paper, by applying ink to the print medium. The ink may be contained in one or more replaceable supply cartridges. Examples of such replaceable supply cartridges include a replaceable ink tank and an ink jet printhead cartridge. An ink jet printhead cartridge, for example, includes both an ink tank and an ink jet micro-fluid ejection device. In contrast, a replaceable ink tank does not include the micro-fluid ejection device, but rather, the micro-fluid ejection device forms part of a printhead assembly.

One such ink jet printer mounts a plurality of ink tanks, with each ink tank containing a supply of a particular color of ink, e.g., black, cyan, magenta, and yellow. Each ink tank is mounted to a micro-fluid ejection device that is separately mounted to the printhead carrier, and is commonly referred to as an on-carrier ink tank system. In an on-carrier ink tank system, the ink is transferred from the ink tank to the micro-fluid ejection device through as series of fluid interfaces, e.g., a felt ink retaining member located in the ink tank and a wick located on the printhead assembly.

SUMMARY OF THE INVENTION

The invention, in one form thereof, is directed to a printhead body for mounting a first micro-fluid ejection chip and a second micro-fluid ejection chip. The printhead body includes a floor having an interior side and an exterior side. A first set of body vias extend through the floor from the interior side to the exterior side. The first set of body vias is positioned to supply ink to the first micro-fluid ejection chip. A second set of body vias extend through the floor from the interior side to the exterior side. The second set of body vias is positioned to supply ink to the second micro-fluid ejection chip. A plurality of ink flow channels are formed on the interior side of the floor. Each individual ink flow channel of the plurality of ink flow channels is in fluid communication with a particular body via of the first set of body vias and is in fluid communication with a particular body via of the second set of body vias.

The invention, in another form thereof, is directed to a printhead assembly for mounting to an imaging apparatus. The printhead assembly includes a first micro-fluid ejection chip, a second micro-fluid injection chip, a filter cap having a plurality of filter towers, and a printhead body to which the first micro-fluid ejection chip, the second micro-fluid ejection chip, and the filter cap are mounted. The printhead body includes a floor having an interior side and an exterior side. A first set of body vias extend through the floor from the interior side to the exterior side. The first set of body vias is positioned to supply ink to the first micro-fluid ejection chip. A second set of body vias extend through the floor from the interior side to the exterior side. The second set of body vias is positioned to supply ink to the second micro-fluid ejection chip. A plurality of ink flow channels are formed on the interior side of the floor. Each individual ink flow channel of the plurality of ink flow channels is in fluid communication with a particular body via of the first set of body vias and is in fluid communication with a particular body via of the second set of body vias, with each filter tower facilitating fluid communication with a respective one of the plurality ink flow channels.

The invention, in another form thereof, is directed to an imaging apparatus. The imaging apparatus includes a print engine including a printhead carrier, and a printhead assembly mounted to the printhead carrier. The printhead assembly is configured as described above.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
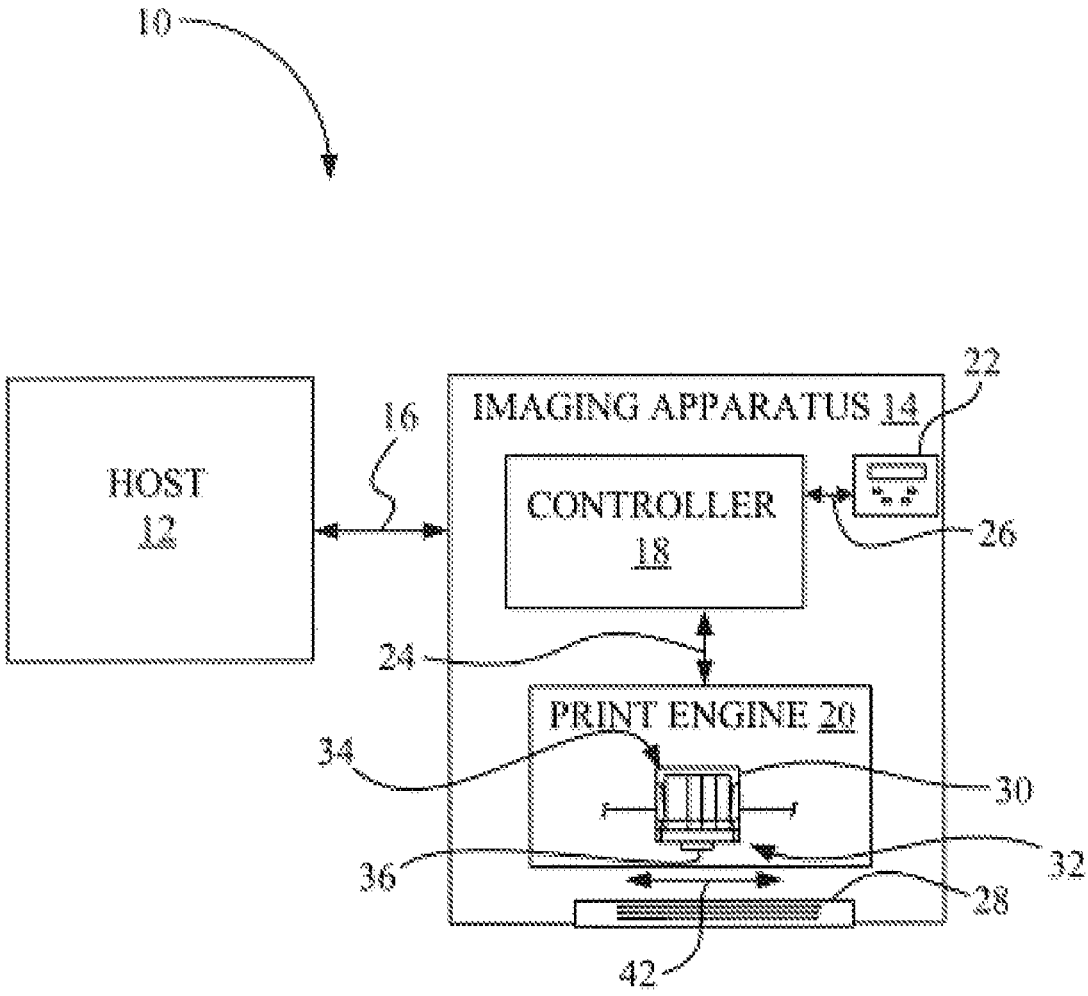
FIG. 1 is a diagrammatic depiction of an imaging system embodying the present invention.

Referring to FIG. 1, there is shown a diagrammatic depiction of an imaging system 10 embodying the present invention. Imaging system 10 may include a host 12 and an imaging apparatus 14. Imaging apparatus 14 communicates with host 12 by way of a communications link 16. Communications link 16 may be established by a direct cable connection, wireless connection or by a network connection such as for example an Ethernet local area network (LAN).

Alternatively, imaging apparatus 14 may be a standalone unit that is not communicatively linked to a host, such as host 12. For example, imaging apparatus 14 may take the form of an all-in-one, i.e., multifunction, machine that includes standalone copying and facsimile capabilities, in addition to optionally serving as a printer when attached to a host, such as host 12.

Host 12 may be, for example, a personal computer including an input/output (I/O) device, such as keyboard and display monitor. Host 12 further includes a processor, input/output (I/O) interfaces, memory, such as RAM, ROM, NVRAM, and a mass data storage device, such as a hard drive, CD-ROM and/or DVD units. During operation, host 12 may include in its memory a software program including program instructions that function as an imaging driver, e.g., printer driver software, for imaging apparatus 14. Alternatively, the imaging driver may be incorporated, in whole or in part, in imaging apparatus 14.

In the embodiment of FIG. 1, imaging apparatus 14 includes a controller 18, a print engine 20 and a user interface 22.

Controller 18 includes a processor unit and associated memory, and may be formed as an Application Specific Integrated Circuit (ASIC). Controller 18 communicates with print engine 20 by way of a communications link 24. Controller 18 communicates with user interface 22 by way of a communications link 26. Communications links 24 and 26 may be established, for example, by using standard electrical cabling or bus structures, or by wireless connection.

Print engine 20 may be, for example, an ink jet print engine configured for forming an image on a sheet of print media 28, such as a sheet of paper, transparency or fabric. Print engine 20 may include, for example, a reciprocating printhead carrier 30.

Figure 2:
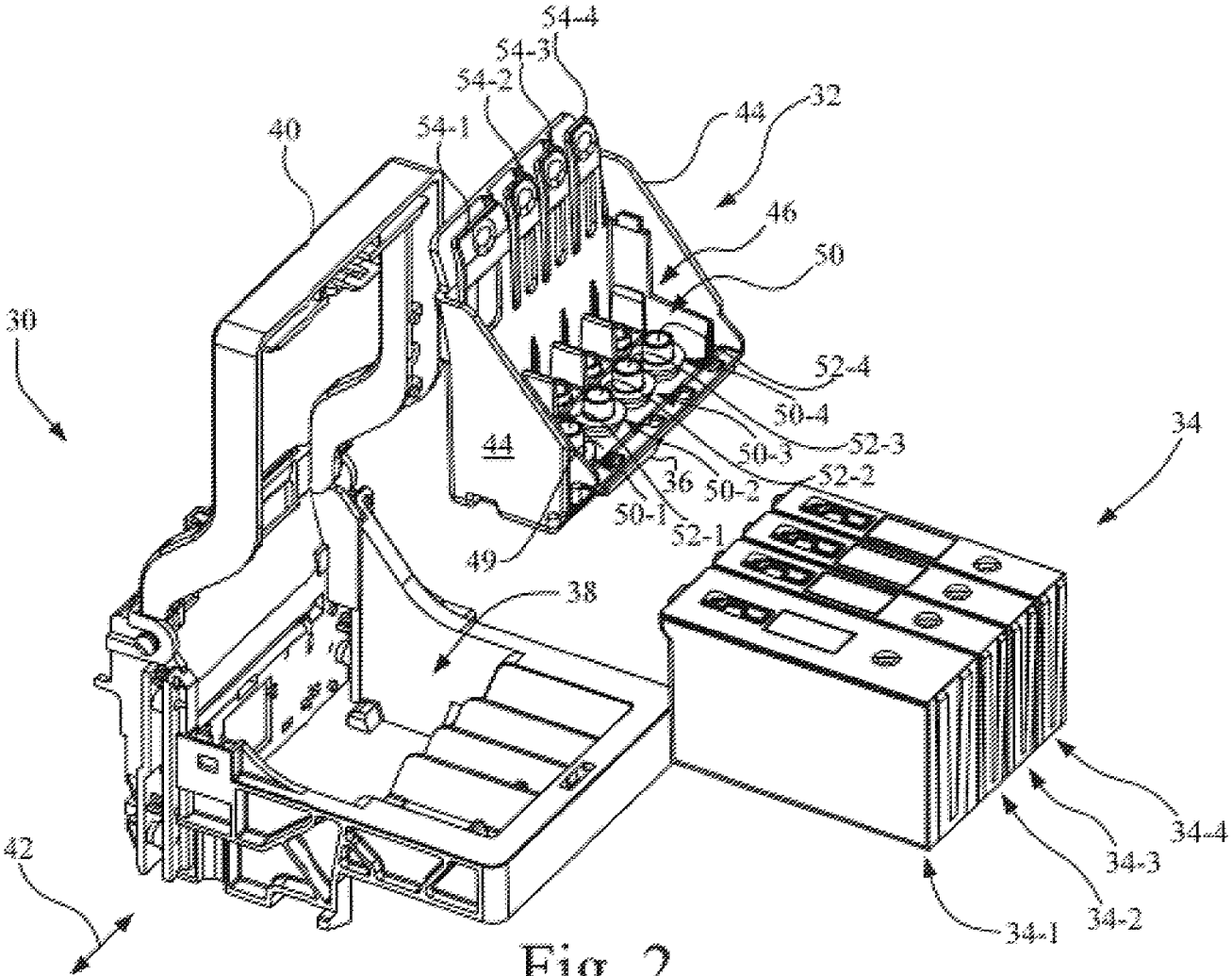
FIG. 2 is a perspective view of the printhead carrier of FIG. 1, with the printhead assembly and ink tanks uninstalled.

FIG. 2 shows in a perspective view printhead carrier 30, with a printhead assembly 32 and a plurality of removable ink tanks 34 in an uninstalled state. Printhead carrier 30 is mechanically and electrically configured to mount and carry at least one printhead assembly 32 that includes two ink jet micro-fluid ejection chips 36, which are individually identified as micro-fluid ejection chip 36-1 and micro-fluid ejection chip 36-2, as shown in FIG. 3.

Figure 3:
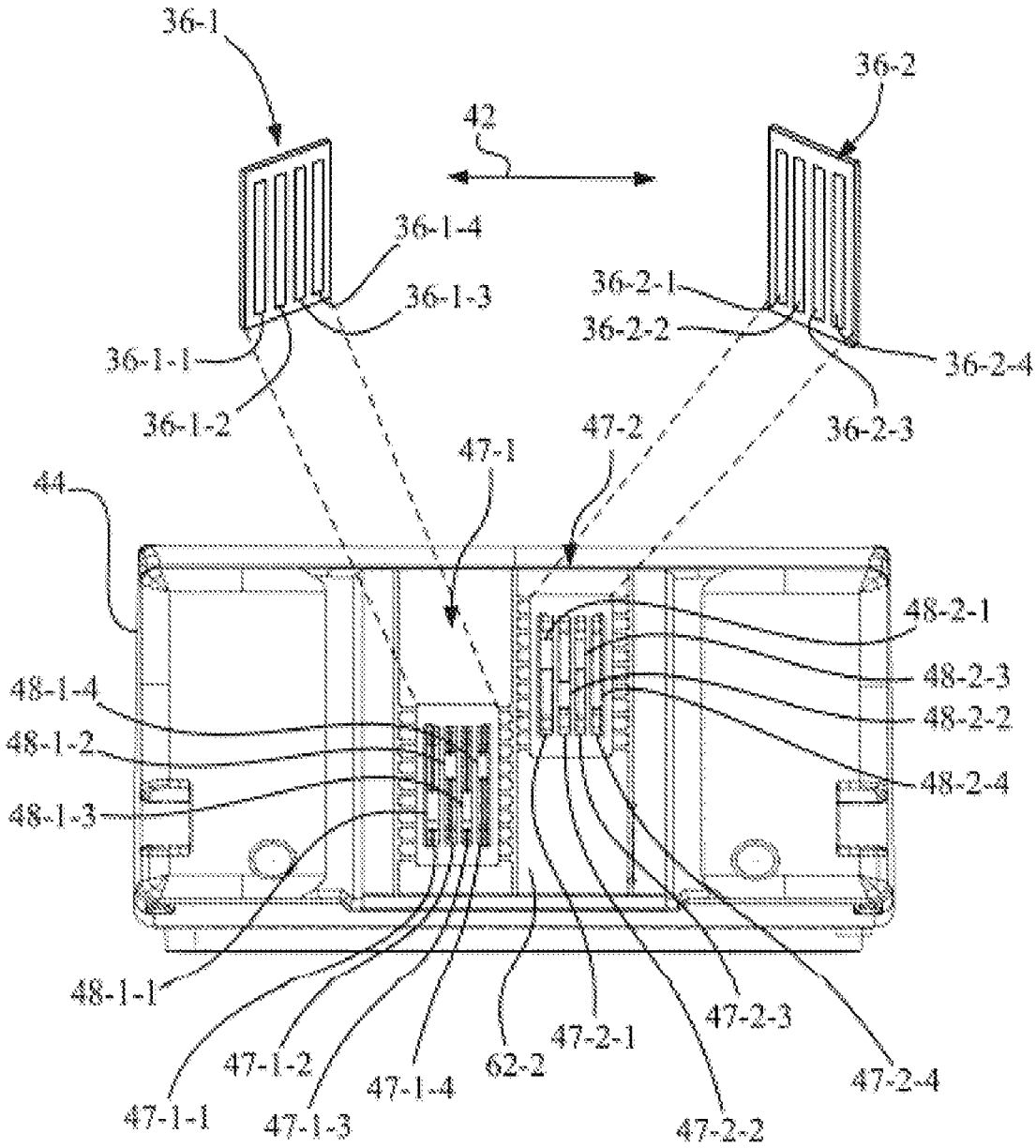
FIG. 3 is a bottom view of the printhead body of the printhead assembly of FIG. 2, with the two micro-fluid ejection chips uninstalled to expose the chip vias and body vias.

In FIG. 3, micro-fluid ejection chip 36-1 and micro-fluid ejection chip 36-2 are shown removed from printhead assembly 32 to expose the chip vias in the respective micro-fluid ejection chips 36. Micro-fluid ejection chip 36-1 includes a respective chip via 36-1-1, chip via 36-1-2, chip vias 36-1-3, and chip via 36-1-4 for each color of ink for supplying ink to a respective ink jet nozzle array. Likewise, micro-fluid ejection chip 36-2 includes a respective chip via 36-2-1, chip via 36-2-2, chip via 36-2-3, and chip via 36-2-4 for each color of ink for supplying ink to a respective ink jet nozzle array. As is known in the art, a "chip via" is an opening in the chip silicon that receives ink from the printhead body and directs the ink to a plurality of ink chambers, such as an ink ejection chamber associated with a respective nozzle opening on a nozzle plate.

Referring again to FIG. 2, printhead assembly 32 is mounted into position to printhead carrier 30 by inserting printhead assembly 32 into a cavity 38 in printhead carrier 30, and is latched in position by a mounting lever 40. Printhead carrier 30 transports printhead assembly 32, and in turn ink jet micro-fluid ejection chip 36, in a reciprocating manner in a bi-directional main scan direction, i.e., axis, 42 over an image surface of the sheet of print media 28 during a printing operation.

Printhead assembly 32 is configured to mount and carry the plurality of removable ink tanks 34, and to facilitate an ink transfer from one or more of the plurality of removable ink tanks 34 to micro-fluid ejection chips 36. The plurality of removable ink tanks 34 may be made, for example, from plastic. The plurality of ink tanks 34 are individually identified as ink tanks 34-1, 34-2, 34-3 and 34-4, and may include a monochrome ink tank containing black ink, and three color ink tanks containing cyan, magenta, and yellow inks.

Figure 4:
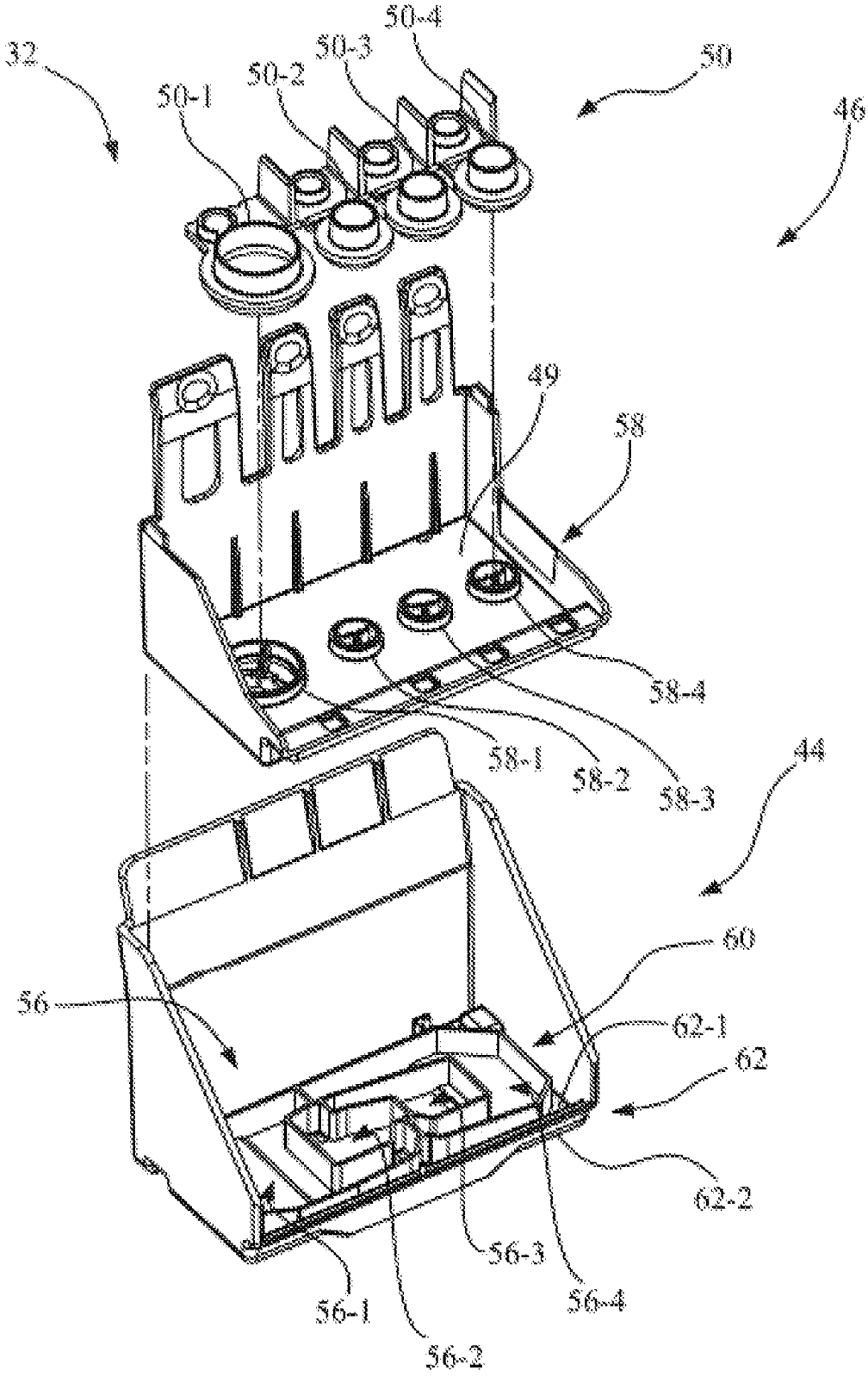
FIG. 4 is an exploded view of the printhead assembly of FIG. 2.

Referring also to FIG. 4, printhead assembly 32 includes a printhead body 44 and a filter cap 46, each of which may be molded from plastic. As shown in FIG. 3, micro-fluid ejection chips 36-1 and 36-2 are mounted to printhead body 44 over sets of body vias (i.e., openings) 47-1 and 47-2, respectively. The set of body vias 47-1 are individually identified as body via 47-1-1, body via 47-1-2, body via 47-1-3, and body via 47-1-4. The set of body vias 47-2 are individually identified as body via 47-2-1, body via 47-2-2, body via 47-2-3, and body via 47-2-4. Each of body via 47-1-1, 47-1-2, 47-1-3, and 47-1-4 has a corresponding via inlet 48-1-1, 48-1-2, 48-1-3, and 48-1-4, respectively. Likewise, each of body via 47-2-1, 47-2-2, 47-2-3, and 47-2-4 has a corresponding via inlet 48-2-1, 48-2-2, 48-2-3, and 48-2-4, respectively. As used herein, a "body via" and its associated "via inlet" is an opening in the printhead body, e.g., printhead body 44, used to direct ink to a particular micro-fluid ejection chip, and more particularly, to a particular chip via of a particular micro-fluid ejection chip.

As shown in FIG. 3, the set of body vias 47-1 and the set of body vias 47-2 are formed in an offset, e.g., staggered, arrangement in printhead body 44 with respect to bi-directional main scan direction 42. Accordingly, micro-fluid ejection chip 36-1 and micro-fluid ejection chip 36-2 are likewise positioned in an offset, e.g., staggered, arrangement that results a swath height in a direction perpendicular to bi-directional main scan direction 42 that is twice as high as each chip individually.

When micro-fluid ejection chip 36-1 is mounted to printhead body 44, body via 47-1-1 is in fluid communication with chip via 36-1-1, body via 47-1-2 is in fluid communication with chip via 36-1-2, body via 47-1-3 is in fluid communication with chip via 36-1-3, and body via 47-1-4 is in fluid communication with chip via 36-1-4. Likewise, when micro-fluid ejection chip 36-2 is mounted to printhead body 44, body via 47-2-1 is in fluid communication with chip via 36-2-1, body via 47-2-2 is in fluid communication with chip via 36-2-2, body via 47-2-3 is in fluid communication with chip via 36-2-3, and body via 47-2-4 is in fluid communication with chip via 36-2-4.

Referring again to FIG. 2, filter cap 46 is attached to printhead body 44 by a hermetic seal, such as by welding or adhesive attachment. Filter cap 46 has a filter cap body 49 configured with a plurality of wick retainers 50, individually identified as wick retainer 50-1, wick retainer 50-2, wick retainer 50-3, and wick retainer 50-4. Each wick retainer 50-1, 50-2, 50-3, and 50-4 mounts a respective wick 52-1, 52-2, 52-3, and 52-4 that operably engages the respective ink output ports of ink tanks 34-1, 34-2, 34-3 and 34-4, respectively, to facilitate fluid communication between ink output ports of ink tanks 34-1, 34-2, 34-3 and 34-4 and micro-fluid ejection chips 36. Each of wicks 52-1, 52-2, 52-3, and 52-4 may be constructed from a porous material, such as for example, from a porous felt material or a porous foam material. Ink tanks 34-1, 34-2, 34-3 and 34-4 are individually mounted to printhead assembly 32 by way of individual latches 54-1, 54-2, 54-3 and 54-4.

FIG. 4 is an exploded view of printhead assembly 32, with filter cap 46 being separated from printhead body 44 to expose a plurality of ink flow channels 56, and with plurality of wick retainers 50 separated from filter cap body 49 to expose a corresponding plurality of filter towers 58. The plurality of ink flow channels 56 are individually identified as ink flow channel 56-1, ink flow channel 56-2, ink flow channel 56-3, and ink flow channel 56-4. The plurality of ink flow channels 56 is defined by a plurality of interconnected walls 60 extending upwardly, i.e., vertically, from a floor 62. During operation, air that is ingested by printhead assembly 32 during ink jetting is accumulated in the plurality of ink flow channels 56, which are located so as to not restrict ink flow. The air storage volume of each of the plurality of ink flow channels 56 is large enough so that it can accommodate the volume of air that is accumulated for the expected life of printhead assembly 32.

Floor 62 of printhead body 44 has an interior side 62-1 facing the plurality of ink flow channels 56 and an exterior side 62-2 which faces micro-fluid ejection chips 36 (see FIG. 3). The set of body vias 47-1 extend through floor 62 from interior side 62-1 to exterior side 62-2, with the set of body vias 47-1 being positioned to supply ink to micro-fluid ejection chip 36-1. The set of body vias 47-2 extend through floor 62 from interior side 62-1 to exterior side 62-2, with the set of body vias 47-2 being positioned to supply ink to micro-fluid ejection chip 36-2. The plurality of ink flow channels 56 are formed on interior side 62-1 of floor 62. In the present embodiment, each individual ink flow channel of the plurality of ink flow channels 56 is in fluid communication with a particular body via from the set of body vias 47-1 and also is in fluid communication with a particular body via of the set of body vias 47-2.

In the present embodiment, the plurality of filter towers 58 are individually identified as filter tower 58-1, filter tower 58-2, filter tower 58-3, and filter tower 58-4, and are positioned to be in fluid communication with ink flow channel 56-1, ink flow channel 56-2, ink flow channel 56-3, and ink flow channel 56-4, respectively, with each filter tower facilitating fluid communication with a respective one of the plurality ink flow channels 56.

Figure 5:
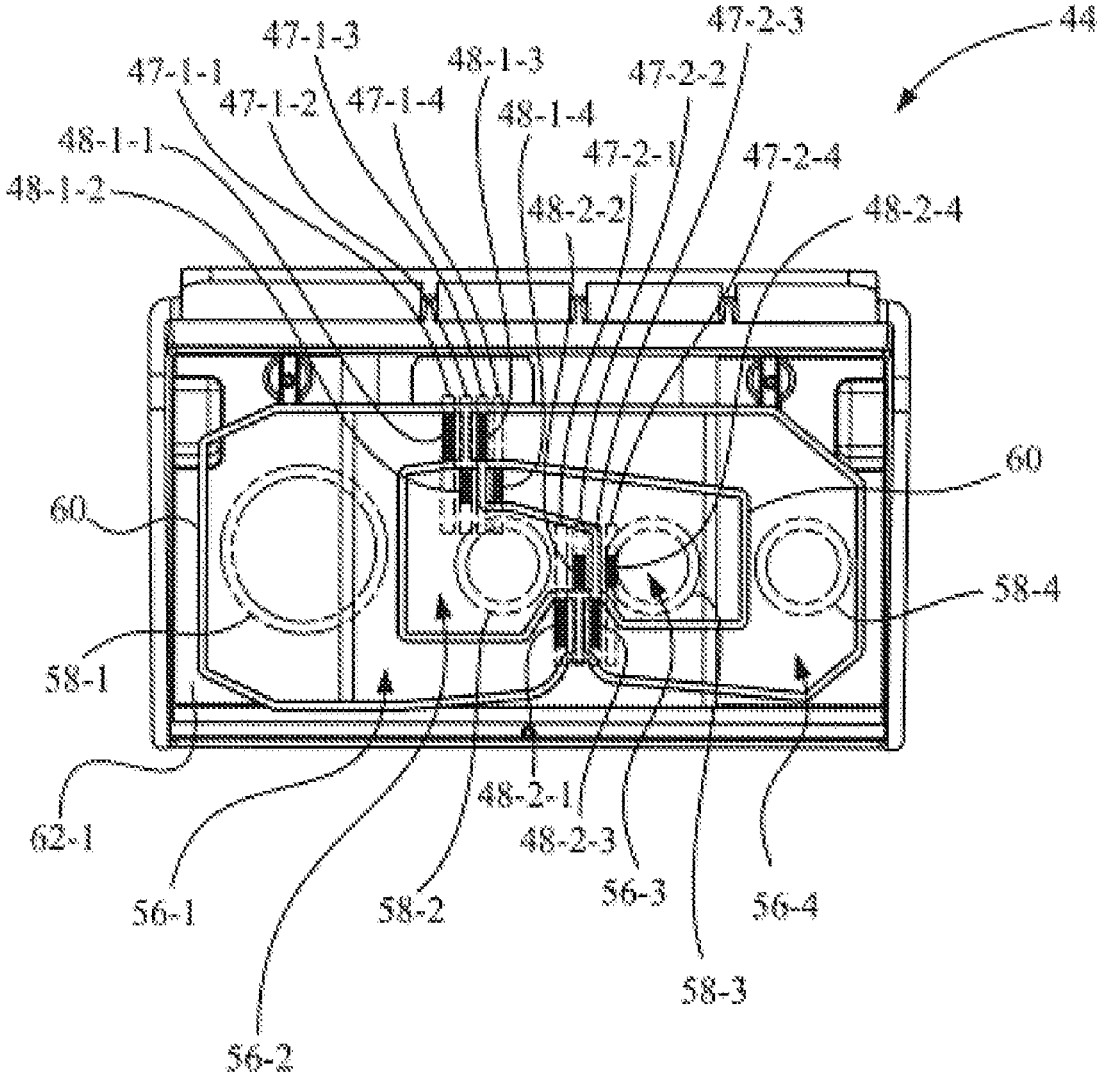
FIG. 5 is a top view of the printhead body of the printhead assembly of FIG. 2 showing the ink flow channel paths.

FIG. 5 is a top view of printhead body 44, with graphical projections of filter tower 58-1, filter tower 58-2, filter tower 58-3, and filter tower 58-4 shown in dashed lines in relation to each of ink flow channel 56-1, ink flow channel 56-2, ink flow channel 56-3, and ink flow channel 56-4.

With the present invention, each of the ink flow channels 56 decrease in cross sectional area toward the respective body vias, i.e., openings in printhead body 44, that supplies ink to the respective micro-fluid ejection chip 36-1, 36-2, so as to move air bubbles toward the respective filter towers 58 and away from micro-fluid ejection chips 36, which reduces the chance of ink flow blockage.

Additionally, a single tank of a particular color of the plurality of ink tanks 34 feeds the corresponding color ink jet nozzle array of both micro-fluid ejection chips 36-1, 36-2. For example, a single black ink tank 34-1 feeds the black ink to both the chip via 36-1-1 of micro-fluid ejection chip 36-1 and to chip via 36-2-1 of micro-fluid ejection chip 36-2 (see, e.g., FIGS. 2, 3 and 5). Likewise, ink tank 34-2 feeds ink to both the chip via 36-1-2 of micro-fluid ejection chip 36-1 and to chip via 36-2-2 of micro-fluid ejection chip 36-2; ink tank 34-3 feeds ink to both the chip via 36-1-4 of micro-fluid ejection chip 36-1 and to chip via 36-2-4 of micro-fluid ejection chip 36-2; and ink tank 34-4 feeds ink to both the chip via 36-1-3 of micro-fluid ejection chip 36-1 and to chip via 36-2-3 of micro-fluid ejection chip 36-2.

As shown in FIGS. 4 and 5, the plurality of ink flow channels 56 are arranged so that the plurality of ink flow channels 56 do not have to cross over one another, and are open topped until covered and sealed with a filter cap 46. Accordingly, each of printhead body 44 and filter cap 46 have a configuration that permits the tooling for each of printhead body 44 and filter cap 46 to be a respective simple two-piece open/shut mold, without use of any slides or lifters.

Referring again to FIG. 5, ink flow channel 56-1 is in fluid communication with body via 47-1-1 and with body via 47-2-1, and ink flow channel 56-1 routes via inlet 48-1-1 of body via 47-1-1 and routes via inlet 48-2-1 of body via 47-2-1 to filter tower 58-1. Ink flow channel 56-2 is in fluid communication with body via 47-1-2 and with body via 47-2-2, and ink flow channel 56-2 routes via inlet 48-1-2 of body via 47-1-2 and routes via inlet 48-2-2 of body via 47-2-2 to filter tower 58-2. Ink flow channel 56-3 is in fluid communication with body via 47-1-4 and with body via 47-2-4, and ink flow channel 56-3 routes each of via inlet 48-1-4 of body via 47-1-4 and via inlet 48-2-4 of body via 47-2-4 to filter tower 58-3. Ink flow channel 56-4 is in fluid communication with body via 47-1-3 and with body via 47-2-3, and ink flow channel 56-4 routes each of via inlet 48-1-3 of body via 47-1-3 and via inlet 48-2-3 of body via 47-2-3 to filter tower 58-4.

Each body via in the sets of body vias 47-1, 47-2 has a geometry that tapers inwardly toward the respective via inlets so as to allow the via inlet to be significantly shorter than the corresponding chip via of micro-fluid ejection chip 36-1 and micro-fluid ejection chip 36-2. This allows the via inlets into the body vias 47-1, 47-2 to be staggered so that the ink flow channels 56 can pass over top of body vias 47-1, 47-2 that are not adjacent to the respective filter tower. For example, the ink flow channel 56-2 passes over body vias 47-1-1 and 47-2-1 and connects to body vias 47-1-2 and 47-2-2 by way of via inlets 48-1-2 and 48-2-2. Ink flow channel 56-3 connects to body vias 47-1-4 and 47-2-4. The outer two ink flow channels 56-1 and 56-4 are C-shaped and are routed around the center two ink flow channels 56-2 and 56-3 to connect with the respective body vias (see FIG. 5).

The configuration of ink flow channels 56 described above allows a single ink tank to feed the appropriate chip vias in multiple micro-fluid ejection chips 36 so that only one tank per color is needed to feed multiple micro-fluid ejection chips 36. The configuration of the present embodiment also leaves the necessary space between the filter towers and the filter cap weld joint for the welding equipment.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A printhead assembly for mounting to an imaging apparatus, comprising:

a first micro-fluid ejection chip;

a second micro-fluid ejection chip;

a filter cap having a plurality of filter towers; and a printhead body to which said first micro-fluid ejection chip, said second micro-fluid ejection chip, and said filter cap are mounted, said printhead body including:

a floor having an interior side and an exterior side;

a first set of body vias extending through said floor from said interior side to said exterior side, said first set of body vias being positioned to supply ink to said first micro-fluid ejection chip;

a second set of body vias extending through said floor from said interior side to said exterior side, said second set of body vias being positioned to supply ink to said second micro-fluid ejection chip; and a plurality of ink flow channels formed on said interior side of said floor, wherein each individual ink flow channel of said plurality of ink flow channels is in fluid communication with a particular body via of said first set of body vias and is in fluid communication with a particular body via of said second set of body vias, with each filter tower facilitating fluid communication with a respective one of said plurality ink flow channels.

2. The printhead assembly of claim 1, wherein said plurality of ink flow channels includes:

a first ink flow channel in fluid communication with a first body via from said first set of body vias and in fluid communication with a first body via of said second set of body vias; and a second ink flow channel in fluid communication with a second body via from said first set of body vias and in fluid communication with a second body via of said second set of body vias, said first ink flow channel having a C-shape and being routed around said second ink flow channel.

3. The printhead assembly of claim 2, wherein said plurality of ink flow channels includes:

a third ink flow channel in fluid communication with a third body via from said first set of body vias and in fluid communication with a third body via of said second set of body vias; and a fourth ink flow channel in fluid communication with a fourth body via from said first set of body vias and in fluid communication with a fourth body via of said second set of body vias, said fourth ink flow channel having a C-shape and being routed around said third ink flow channel.

4. The printhead assembly of claim 1, wherein said plurality of ink flow channels is defined by a plurality of interconnected walls extending upwardly from said floor.

5. he printhead assembly of claim 1, wherein each of said first set of body vias is positioned to be staggered with respect to said second set of body vias, said first micro-fluid ejection chip being mounted over said first set of body vias and said second micro-fluid ejection chip being mounted over said second set of body vias.

6. The printhead assembly of claim 1, wherein each of said printhead body and said filter cap have a configuration such that each o said printhead body and said filter cap is formed by a respective simple two piece open/shut mold, without use of any slides or lifters.

7. An imaging apparatus, comprising:

a print engine including a printhead carrier; and a printhead assembly mounted to said printhead carrier, said printhead assembly including:

a first micro-fluid ejection chip;

a second micro-fluid ejection chip;

a filter cap having a plurality of filter towers; and a printhead body to which said first micro-fluid ejection chip, said second micro-fluid ejection chip, and said filter cap are mounted, said printhead body including:

a floor having an interior side and an exterior side;

a first set of body vias extending through said floor from said interior side to said exterior side, said first set of body vias being positioned to supply ink to said first micro-fluid ejection chip;

a second set of body vias extending through said floor from said interior side to said exterior side, said second set of body vias being positioned to supply ink to said second micro-fluid ejection chip; and a plurality of ink flow channels formed on said interior side of said floor, wherein each individual ink flow channel of said plurality of ink flow channels is in fluid communication with a particular body via of said first set of body vias and is in fluid communication with a particular body via of said second set of body vias, with each filter tower facilitating fluid communication with a respective one of said plurality ink flow channels.

8. The imaging apparatus of claim 7, wherein said plurality of ink flow channels includes:

a first ink flow channel in fluid communication with a first body via from said first set of body vias and in fluid communication with a first body via of said second set of body vias; and a second ink flow channel in fluid communication with a second body via from said first set of body vias and in fluid communication with a second body via of said second set of body vias said first ink flow channel having a C-shape and being routed around said second ink flow channel.

9. The imaging apparatus of claim 8, wherein said plurality of ink flow channels includes:

a third ink flow channel in fluid communication with a third body via from said first set of body vias and in fluid communication with a third body via of said second set of body vias; and a fourth ink flow channel in fluid communication with a fourth body via from said first set of body vias and in fluid communication with a fourth body via of said second set of body vias, said fourth ink flow channel having a C-shape and being routed around said third ink flow channel.

10. The imaging apparatus of claim 7, wherein said plurality of ink flow channels is defined by a plurality of interconnected walls extending upwardly from said floor.

11. The imaging apparatus of claim 7, wherein each of said first set of body vias is positioned to be staggered with respect to said second set of body vias said first micro-fluid ejection chip being mounted over said first set of body vias and said second micro-fluid ejection chip being mounted over said second set of body vias.

12. The imaging apparatus of claim 7, wherein each of said printhead body and said filter cap have a configuration such that each of said printhead body and said filter cap is formed by a respective simple two piece open/shut mold, without use of any slides or lifters.

* * * * *